US009862520B2

(12) United States Patent
Fan

(10) Patent No.: US 9,862,520 B2
(45) Date of Patent: Jan. 9, 2018

(54) PROLATE SPHEROIDAL BALL PACKAGING

(71) Applicant: NIKE, Inc., Beaverton, OR (US)

(72) Inventor: Richard S. Fan, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/154,047

(22) Filed: May 13, 2016

(65) Prior Publication Data

US 2017/0327264 A1 Nov. 16, 2017

(51) Int. Cl.
*B65D 5/00* (2006.01)
*A63B 47/00* (2006.01)

(52) U.S. Cl.
CPC ..... *B65D 5/009* (2013.01); *A63B 47/00* (2013.01)

(58) Field of Classification Search
CPC ..... A63B 47/00; B65D 5/00; B65D 5/009; B65D 5/019; B65D 5/02; B65D 5/029; B65D 5/42; B65D 5/4204; B65D 5/44; B65D 5/46; B65D 5/50; B65D 5/5019; B65D 5/5023
USPC ..... 206/315.9, 485, 780
See application file for complete search history.

(56) References Cited

U.S. PATENT DOCUMENTS 3,815,735 A * 6/1974 Cucuo ..... B65D 5/50 206/315.9
4,452,355 A * 6/1984 Benham ..... B65D 5/5023 206/315.9
6,199,692 B1 * 3/2001 Van Ness ..... B65D 5/5019 206/315.9
6,568,528 B2 * 5/2003 Murray ..... B65D 5/5019 206/315.9
2016/0272358 A1 * 9/2016 Fan ..... B65D 5/029

FOREIGN PATENT DOCUMENTS

GB 785227 A * 10/1957 ..... B65D 5/5019
GB 1217067 A * 12/1970 ..... B65D 5/0209

* cited by examiner

*Primary Examiner* — Bryon Gehman
(74) *Attorney, Agent, or Firm* — Quinn IP Law

(57) ABSTRACT

A package for a prolate spheroidal ball having a longitudinal axis. A back plate is disposed between a first end and a second end of the package. A first cradle extends from the back plate adjacent the first end, and is operative to receive a first portion of the prolate spheroidal ball along the longitudinal axis. A wing portion extends from the back plate adjacent the second end, and at least partially circumscribes the longitudinal axis of the prolate spheroidal ball. A flap portion extends from the wing portion and defines an end surface of the package. The longitudinal axis intersects the flap portion.

14 Claims, 2 Drawing Sheets

PROLATE SPHEROIDAL BALL PACKAGING

TECHNICAL FIELD

This disclosure generally relates to packaging for sport balls and, more specifically, to prolate spheroidal sports balls.

BACKGROUND

Sports balls may be stored, transported, and marketed with or without packages. The packaging may include boxes, bags, or partial versions thereof.

SUMMARY

A package for a prolate spheroidal ball is provided. The package has a first end and a second end and the prolate spheroidal ball defines a longitudinal axis. The package includes a back plate disposed between the first end and the second end.

A first cradle extends from the back plate adjacent the first end. The first cradle is operative to receive a first portion of the prolate spheroidal ball along the longitudinal axis. A wing portion extends from the back plate adjacent the second end and at least partially circumscribes the longitudinal axis of the prolate spheroidal ball.

A flap portion extends from the wing portion and defines an end surface of the package. The longitudinal axis intersects the flap portion, such that the prolate spheroidal ball is covered by the flap portion.

The above features and advantages, and other features and advantages, of the present subject matter are readily apparent from the following detailed description of some of the best modes and other embodiments for carrying out the disclosed structures, methods, or both.

DETAILED DESCRIPTION

Figure 2:
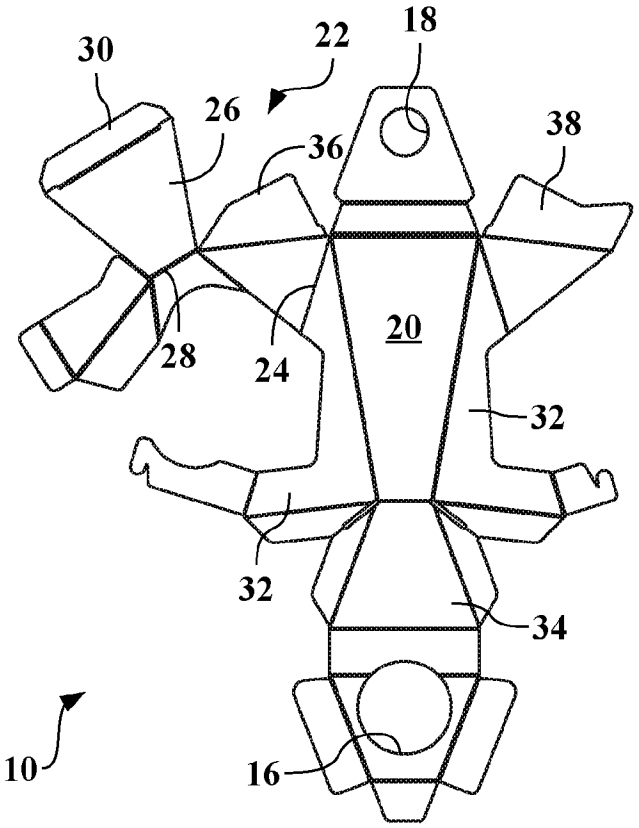
FIG. 2 is a schematic, top view of the packaging shown in FIG. 1, without the ball, in a flat or completely unfolded position.
Figure 1:
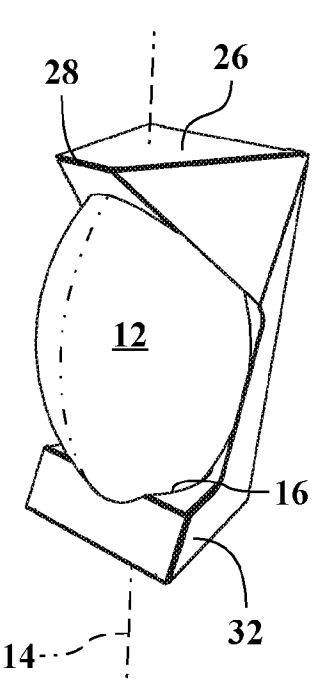
FIG. 1 is a schematic, isometric view of packaging for a prolate spheroidal ball, such as an American football, in a fully assembled state.

Referring to the drawings, like reference numbers correspond to like or similar components whenever possible throughout the several figures. There are shown in FIG. 1 and FIG. 2 two views of a packaging assembly or package

10 for a ball 12. FIG. 1 shows the package 10 fully assembled and capturing or holding the ball 12, such that the ball 12 and package 10 may be shipped or displayed for retail sale. FIG. 2 shows the packaging fully disassembled, unfolded, or laid flat, with the ball 12 removed.

While the present disclosure may be described with respect to specific applications or industries, those skilled in the art will recognize the broader applicability of the disclosure. Those having ordinary skill in the art will recognize that terms such as "above," "below," "upward," "downward," et cetera, are used descriptively of the figures, and do not represent limitations on the scope of the disclosure, as defined by the appended claims. Any numerical designations, such as "first" or "second" are illustrative only and are not intended to limit the scope of the disclosure in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

The ball 12 shown defines a longitudinal axis 14 that is larger than the transverse width. Therefore, the ball 12 is a prolate spheroid, as opposed to an oblate spheroid. In particular, the ball 12 may be an American football. However, other types of sports balls may be used with the package 10 described herein, including, without limitation, balls for rugby Australian rules football. Furthermore, the package 10 may be used to hold other prolate spheroidal objects, including, without limitation, trophies, pottery, or vases.

Any reference to front and rear, up and down, or similar direction language is used only for illustrative purposes. Reference directions may correspond to orientations of the package 10 and the ball 12 for display purposes, such as retail sales environments. For example, in the orientation shown in FIG. 1, numerous units of the package 10 and the ball 12 may be stacked on shelves for sale, with additional units to each side, and on top of, the package 10 and the ball 12 shown. However, other orientations may also be used in both display and shipping.

As illustrated in FIG. 2, the package 10 is formed from a one-piece, continuous body having a plurality of connected panel elements. The continuous body is a unitary component, as opposed to multiple components that are separately formed and then attached. Each of the panel elements of the continuous body is planar and attached to one or more adjacent panel elements via seams or fold lines. Cuts or slots are also formed at specific locations between adjacent panel elements.

The package 10 is foldable between a flat position, in which all elements are aligned along a single plane, as shown in FIG. 2, and a fully assembled state, in which the ball 12 is captured or held by the package 10, as shown in FIG. 1. The continuous body of the package 10 may be die cut, and fold lines between panel elements may be die pressed to impart the fold lines and shape illustrated in FIG. 2. However, other manufacturing techniques may be used to form the continuous body of the package 10.

The package 10 may be formed with any suitable material capable of holding the ball 12 during manufacture, shipping, and display, including stacks of multiple units of the package 10 and ball 12. Materials for the continuous body of the package 10 include, without limitation: paperboard or boxboard, cardstock paper, cardboard (corrugated or non-corrugated), plastic, or composite materials. Both the interior and exterior of the package 10 may be painted or printed from logos and information about the ball 12 and the producers or sellers thereof.

During manufacture, the package 10 may initially be formed in the flat position, as laid out in FIG. 2. The package 10 then undergoes a series of folding and mating process, some of which may be sequential, and during which the ball 12 is inserted, before reaching the fully assembled state or position, as shown in FIG. 1. By forming the package 10 from the continuous body, only one component is necessary for packaging the ball 12, and production costs and time may benefit from reduced or eliminated mating or joining processes.

The elements and features of the package 10 are generally viewable in FIG. 2 and will be described in more detail with reference to FIGS. 3-6. A first cradle 16 and a second cradle 18 are disposed at respective first and second ends of the package 10 and configured to hold respective first second portions of the ball 12, when the package 10 is at least partially assembled.

A trapezoidal back plate 20 acts as a central structural element for the continuous body of the package 10. As best viewed in FIG. 1, the back plate 20 is substantially parallel to the longitudinal axis 14 of the ball 12. The back plate 20 may have other geometric shapes, including triangular, parallelogram, or rectangular. A wing portion or wing element 22 is foldable about a first fold line or wing fold line 24, which intersects the back plate 20. A flap portion or flap element 26 is formed on the wing element 22 and is foldable about a second line or flap fold line 28. A tuck tab or tab 30 extends from the flap element 26.

Two side panels 32 extend outward from the back plate 20. The wing element 22 is attached to one of the side panels 32 via the wing fold line 24. A bottom panel 34 is opposite the back plate 20 from the flap element 26, and is foldable from the back plate 20. A first side flap 36 extends from the wing element 22 and a second side flap 38 extends from opposite the wing element 22 at the second end (toward the top, as viewed in FIG. 2) of the package 10.

Figure 3:
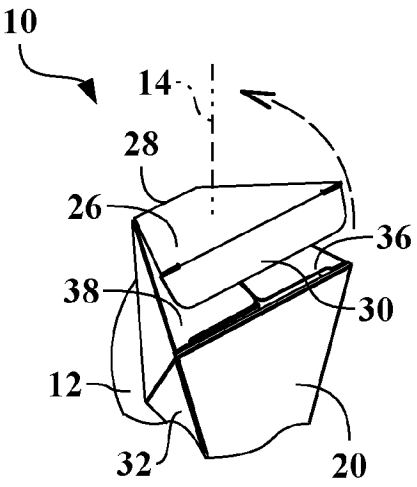
FIG. 3 is a schematic, isometric, detail view of the top rear of the packaging shown in FIGS. 1-2, illustrating unfolding of a flap element and progression of the packaging toward a partially assembled state in which the ball is releasable.
Figure 4:
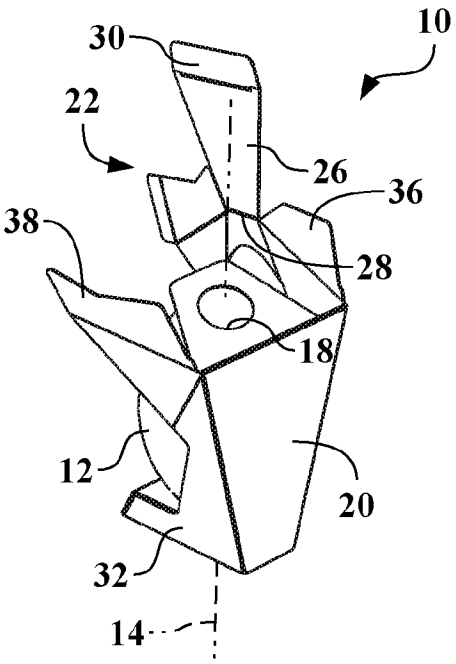
FIG. 4 is a schematic, isometric view of the packaging shown in FIGS. 1-3, illustrating progression of the packaging, by unwrapping or rotating a wing element, to the partially assembled state.

Referring also to FIGS. 3-6, there are shown additional views of the package 10 in various states of assembly between the fully assembled state shown in FIG. 1 and the flat state shown in FIG. 2. FIG. 3 shows a detail view of the back side of the package 10, illustrating the flap element 26 rotating away from the back plate 20. FIG. 4 shows further progression of the packaging to the partially assembled state by unfolding, unwrapping, or rotating the wing element 22 about the longitudinal axis 14.

Figure 6:
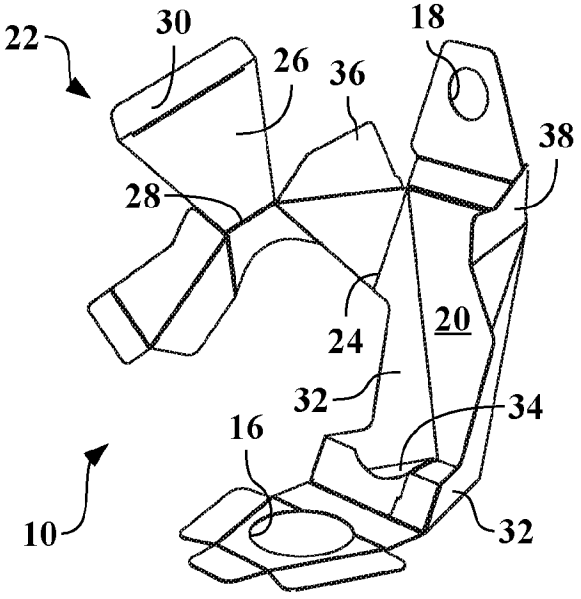
FIG. 6 is a schematic, top view of the packaging shown in FIGS. 1-5, illustrating a further intermediary state of the packaging between the partially assembled state and the fully flat state.
Figure 5:
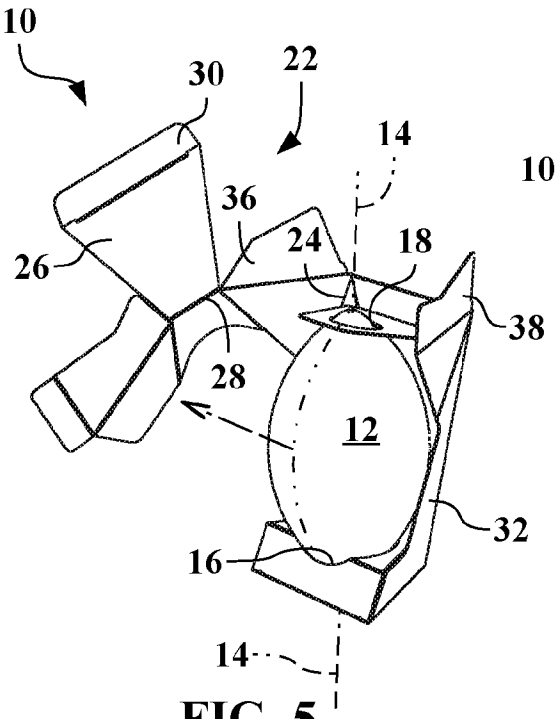
FIG. 5 is a schematic, isometric view of the packaging shown in FIGS. 1-4, illustrating the packaging in the partially assembled state, such that the ball may be released.

FIG. 5 shows a rotated view, relative to FIG. 4, of the package 10 in the partially assembled state. In FIGS. 4 and 5, the ball 12 is no longer fully captured by the package 10, such that the ball 12 may be removed therefrom. FIG. 6 further illustrates the package 10 between the partially assembled state, as shown in FIGS. 4 and 5, and the fully flat state, as shown in FIG. 2.

The figures represent a progression of disassembly, including removal of the ball 12, of the package 10 beginning with FIG. 1 and continuing with FIGS. 3-6, consecutively. The figures also represent a progression of assembly of the package 10, including placement or insertion of the ball 12, beginning with FIG. 2, and continuing with FIGS. 6, 5, 4, and 3.

The tab 30 is a trapezoidal projection from the flap element 26 that may be tucked or inserted into the upper portion of the package 10 to retain the flap element 26 with a friction fit, but is removable by an operator or end purchaser. The first side flap 36 and the second side flap 38 cooperate to define a slot into which the tab 30 may be inserted.

As shown in FIG. 3, to begin removing the ball 12 from the package 10, the tab 30 is un-tucked and the flap element 26 is rotated away from the back plate 20. The flap element 26 rotates about the flap fold line 28, which may be substantially perpendicular to the longitudinal axis 14.

The flap element 26 folds between, at least, an extended position planar with the wing element 22, as illustrated in FIGS. 4 and 5, and a tucked position that is angular to the wing element 22 and substantially perpendicular to the back plate 20, as illustrated in FIG. 1. In the tucked position, the flap element 26 is restraining movement of, at least, the planar element defining the second cradle 18. Therefore, in the tucked position, the flap element 26 allows the package 10 to hold the ball 12 without the use of adhesives or fasteners, such as glue, tape, or snaps.

As shown in FIGS. 4 and 5, after the flap element 26 is rotated away from the back plate 20, the first side flap 36 and the second side flap 38 are no longer trapped between the flap element 26 and the second cradle 18. Additionally, the wing element 22 is free to swing or rotate about the wing fold line 24. Once the flap element 26 and the wing element 22 are rotated, the second cradle 18 is no longer restrained in the position shown in FIGS. 4 and 5. Therefore, FIGS. 4 and 5 illustrate the package 10 at the partially assembled state, in which the ball 12 is removable from the package 10 by pulling the ball 12 outward (away from the back plate 20), upward, or both.

The second cradle 18 may be referred to as a soft or loose cradle, because it is moveable when the packaging is in the partially assembled state. The second cradle 18 selectively intersects the longitudinal axis 14 and is configured to hold a one end of the ball 12.

The wing fold line 24 is angled relative to the longitudinal axis 14 and intersects the back plate 20. Therefore, the wing element 22 is configured to wrap around the second cradle 18 and position the flap element 26 to cover the second cradle 18.

The wing element 22 folds between at least an extended position, which is planar with the back plate 20, as shown in FIG. 2, and a wrapped position, which is angular to the back plate 20, as shown in FIGS. 3-6. In the wrapped position, the wing element 22 at least partially circumscribes the ball 12 and an arced portion of the wing element may be in contact with the ball 12, as shown in FIG. 1. In some configurations, and as shown in the figures, the wing element 22 may circumscribe the longitudinal axis 14 by greater than 180 degrees.

Unfolding the flap element 26 from the tucked position and rotating the wing element 22 from the wrapped position adjusts the continuous body from the fully assembled state to the partially assembled state, such that the ball 12 is releasable from the package 10. Therefore, a relatively small amount of movement allows an end user to remove the ball 12.

In alternative packaging configurations, removal of the sports ball located therein involves numerous steps or movements, and may involve releasing fasteners, tapes, or adhesives. However, removing the ball 12 from the package 10 involves only rotating the flap element 26 about the flap fold line 28 and rotating the wing element 22 about the wing fold line 24, such that the wing element 22 unwraps the second cradle 18.

Furthermore, removal of the ball 12 is nondestructive to the package 10, and the package 10 may be partially or fully disassembled and reassembled multiple times. The package 10 may not require any adhesives or tape to hold the ball 12 in the fully assembled position. However, tamper-evident tape or stickers may be used to seal the package 10 or to indicate whether the ball 12 has been previously removed.

As best viewed in FIG. 6, the ball 12 must be removed in order to disassemble the panel elements defining the first cradle 16, such that the first cradle 16 may be referred to as a hard or locked cradle. The first cradle 16 intersects the longitudinal axis 14 and is configured to hold an opposite end of the ball 12 from the second cradle 18. The bottom panel 34 and the second cradle 18 also hold the side panels 32 at an angle to the back plate 20.

As shown in the figures, the flap element 26 and the bottom panel 34 are perpendicular to the longitudinal axis 14 when the package 10 is in the fully assembled state. Therefore, multiple units of the package 10 and the ball 12 may be stacked vertically on top of one another. The back plate 20 is parallel to the longitudinal axis 14 and perpendicular to the flap element 26, such that there are three panels or surfaces of the package 10 having square or right angle relationships to the longitudinal axis. These square elements may promote ease of shipping, storage, or display for the package 10 and the ball 12.

The triangular side panels 32 angle inward along the back plate 20, in a partially geodesic fashion that closely cradles or tracks the shape of the ball 12. The geodesic shape may reduce the total volume occupied relative to a cube matching the outer envelope of the package 10. Therefore, relatively more units of the package 10 and ball 12 may be disposed within shipping containers.

The continuous body lacks, particularly in the fully assembled state, any exposed complete rectangular panel elements. Therefore, the panel elements of the package 10 have non-orthogonal geometric patterns.

As laid out in FIGS. 2 and 6-3, a method of assembling the package 10 from the continuous, one-piece body may include folding the first cradle 16 at a first end of the one-piece body. Assembling the first cradle 16 positions the bottom panel 34 and the side panels 32 relative to the back plate 20. One end of the ball 12 may then be inserted into the first cradle 16, such that the first cradle 16 is locked in positon.

The second cradle 18, at the opposite end of the continuous body, is then folded over the other end of the ball 12. Note that the ball 12 may have a preferred orientation within the package 10, in order to display logos or features of the ball 12, but is generally reversible relative to the structure of the package 10.

The wing element 22 is then wrapped around the end of the ball 12 and the second cradle 18, such that the wing element 22 at least partially circumscribes the ball 12. The flap element 26 is folded down from the wing element 22 to cover the second cradle 18. The tab 30 is tucked into a portion of the wing element 22 to trap the second cradle 18 and place the continuous body into the fully assembled position, without adhesives.

The detailed description and the drawings or figures are supportive and descriptive of the subject matter discussed herein. While some of the best modes and other embodiments for have been described in detail, various alternative designs, configurations, and embodiments exist.

The invention claimed is:

1. A package for receiving a prolate spheroidal ball having a longitudinal axis, comprising:

a back plate, substantially parallel to the longitudinal axis of the received ball;

a first cradle intersecting the longitudinal axis and configured to hold a first end of the received ball;

a second cradle intersecting the longitudinal axis and configured to hold a second end of the received ball;

a wing element foldable about a first fold line between at least an extended position, which is planar with the back plate, and a wrapped position, which is angular to the back plate and the wing element is wrapped around the second cradle, wherein the first fold line is angled relative to the longitudinal axis and intersects the back plate; and a flap element formed on the wing element and foldable about a second fold line between at least an extended position, which is planar with the wing element, and a tucked position, which is angular to the wing element, wherein, when the wing element is in the wrapped position and the flap element is in the tucked position, the second fold line of the flap element is substantially perpendicular to the longitudinal axis and the flap element prevents separation of the second cradle from the received ball.

2. The package of claim 1, wherein the package is formed from a continuous body, the continuous body is configured to be foldable between:

a flat state, in which all portions of the continuous body are aligned along a single plane;

a partially assembled state, in which the continuous body is not planar and the ball is releasable from the package; and a fully assembled state, in which the ball is received by the package; and wherein moving the flap element from the tucked position and moving the wing element from the wrapped position places the continuous body in the partially assembled position, such that the received ball is releasable from the package.

3. The package of claim 2, wherein the flap is substantially perpendicular to the longitudinal axis and the back plate when in the tucked position.

4. The package of claim 3, wherein the back plate has a trapezoidal outline.

5. The package of claim 4, further comprising:

a side panel attached to the back plate, wherein the second fold line is disposed at an intersection of the wing element and the side panel.

6. A package for receiving a prolate spheroidal ball defining a longitudinal axis, the package having a first end and a second end and comprising:

a back plate disposed between the first end and the second end;

a first cradle extending from the back plate adjacent the first end, wherein the first cradle is operative to receive and surround a first portion of the received prolate spheroidal ball along the longitudinal axis;

a wing portion extending from the back plate adjacent the second end and at least partially circumscribing the longitudinal axis of the received prolate spheroidal ball; and a flap portion extending from the wing portion to define an end surface of the package, wherein the longitudinal axis of the received prolate spheroidal ball intersects the flap portion.

7. The package of claim 6, further comprising:

a second cradle extending from the back plate adjacent the second end, wherein the second cradle is operative to receive and surround a second portion of the received prolate spheroidal ball along the longitudinal axis, such that the first portion of the received prolate spheroidal ball is disposed within the first cradle and the second portion of the received prolate spheroidal ball is disposed within the second cradle.

8. The package of claim 7, wherein the received prolate spheroidal ball is operatively removable from the package in a manner that is nondestructive to the package.

9. The package of claim 7, further comprising:

a first side flap portion and a second side flap portion, each disposed at the second end of the package, wherein the first side flap portion extends from the wing portion; and wherein each of the first side flap portion and the second side flap portion are disposed between the flap portion and the second cradle.

10. The package of claim 9, further comprising:

a tuck tab extending from the flap portion between each of the respective first side flap portion and second side flap portion and the back plate, wherein the tuck tab is substantially parallel to the back plate.

11. The package of claim 6, wherein the back plate is trapezoidal.

12. The package of claim 6, wherein the package is formed from a unitary sheet of paperboard.

13. The package of claim 12, wherein the package is configured to be fully assembled without use of an adhesive.

14. The package of claim 6, wherein the flap portion extends from the wing portion at a first fold line;

wherein the first fold line is perpendicular to the longitudinal axis of the received prolate spheroidal ball and parallel to the back plate.

* * * * *